US005138727A

United States Patent [19]

Hanes et al.

[11] Patent Number: 5,138,727

[45] Date of Patent: Aug. 18, 1992

[54] FOLDING SOFA BED FRAME STRUCTURE WITH ANTI-TOPPLE LINKAGE AND MOVABLE MATTRESS SUPPORT BAR

[75] Inventors: Fred E. Hanes, Muldrow, Okla.; Joseph E. Becker, Barling, Ark.

[73] Assignee: Hickory Springs Manufacturing Company, Hickory, N.C.

[21] Appl. No.: 674,518

[22] Filed: Mar. 22, 1991

[51] Int. Cl.[5] ..... A47C 17/04

[52] U.S. Cl. ..... 5/13; 5/29

[58] Field of Search ..... 5/13, 57.2, 29, 31, 5/32, 35, 36

[56] References Cited

U.S. PATENT DOCUMENTS

| | | | |
|---|---|---|---|
| 1,288,682 | 12/1918 | Richardson . | |
| 1,626,801 | 5/1927 | Fichtenbaum . | |
| 1,675,883 | 7/1928 | Dyke . | |
| 1,745,459 | 2/1930 | Sterbenz . | |
| 1,820,167 | 8/1931 | Taffel . | |
| 1,945,186 | 1/1934 | Frank . | |
| 3,065,474 | 11/1962 | Katz | 5/13 |
| 3,281,870 | 11/1966 | Katz . | |
| 3,281,871 | 11/1966 | Katz | 5/13 |
| 3,284,811 | 11/1966 | Rogers . | |
| 3,292,188 | 12/1966 | Gerth | 5/13 |
| 3,395,409 | 8/1968 | Eakins . | |
| 3,771,178 | 11/1973 | Inman | 5/13 |
| 3,854,153 | 12/1974 | Fadler et al. . | |
| 3,868,733 | 3/1975 | Spitz et al. . | |
| 3,871,035 | 3/1975 | Gerth | 5/13 |
| 3,903,553 | 9/1975 | Metayer | 5/13 |
| 3,984,883 | 10/1976 | Wong . | |
| 4,253,205 | 3/1981 | Mikos . | |
| 4,301,559 | 11/1981 | Geenberghe . | |
| 4,399,571 | 8/1983 | Joyce . | |
| 4,571,755 | 2/1986 | Stevens | 5/13 |
| 4,631,764 | 12/1986 | Moskowitz | 5/13 |
| 4,669,134 | 6/1987 | Mikos | 5/13 |
| 4,800,598 | 1/1989 | Arft | 5/13 |
| 4,850,065 | 7/1989 | Siderski | 5/13 |

*Primary Examiner*—Renee S. Luebke
*Assistant Examiner*—F. Saether
*Attorney, Agent, or Firm*—Shefte, Pinckney & Sawyer

[57] ABSTRACT

A folding sofa bed frame having head, intermediate and foot bed sections pivotally connected end-to-end and constrained by a linkage arrangement to move in a predetermined pattern between a folded position and a horiziontally extended position. The linkage arrangement includes a bracing link with a stud which, in the extended position, engages the rearward side of an upright support link by which the structure is mounted within the sofa bed frame, to act as a stop member against undesired accidental upward tilting of the structure when weight or force is placed against the head section. A transverse mattress support bar is affixed to a pivoting control link also operated by the bracing link for movement of the mattress support bar into a retracted position closely adjacent the intermediate section when the structure is folded and a dropped position spaced below the intermediate section when the structure is extended, thereby out of interference with comfortable sleeping use of the bed frame.

7 Claims, 6 Drawing Sheets

FOLDING SOFA BED FRAME STRUCTURE WITH ANTI-TOPPLE LINKAGE AND MOVABLE MATTRESS SUPPORT BAR

BACKGROUND OF THE INVENTION

The present invention relates generally to folding bed frame structures and, more particularly, to folding bed frames of the type specially adapted for opening and folding articulation from and into the enclosure of a sofa frame or the like.

Convertible sofa beds having widely varying folding bed frame structures are in common use. Characteristically, the folding bed frames of such sofa beds are provided with a plurality of bed sections pivotally connected in end-to-end relation and operatively associated with a linkage arrangement for mounting within the rectangular enclosure of a sofa bed frame defined by its side frame members, which normally comprise the sofa armrests, its sofa back and a front rail, to be articulable between a folded or retracted condition stored within the sofa frame enclosure and a horizontally extended condition disposed and extending outwardly from the enclosure over and beyond the front rail of the sofa frame.

Over the years, substantial activity has been devoted to the improvement of folding bed frame structures of this type, generally toward the common objective of providing a simple linkage arrangement which is compactly foldable and which requires a minimal amount of space for articulating the bed sections into and out of the enclosure of the sofa frame. While contemporary sofa bed frame structures substantially satisfy these objectives, there remain certain disadvantages which are common to most conventional bed frame structures. One such disadvantage is the dangerous tendency of a sofa bed frame structure, when fully extended for sleeping, to tilt upwardly at its foot end section whenever the weight of a person or persons supported on the bed frame structure is concentrated at the opposite head end section, thereby posing a potential risk of injury. An additional disadvantage of conventional sofa bed frame structures is the provision of a transverse mattress support bar extending across the width of the intermediate primary load-bearing section of the structure. While such mattress support bar is generally considered necessary or desirable to provide load bearing support for the mattress, this bar in most conventional sofa bed frame structures is noticeably felt by users sleeping on the sofa bed in its extended position and thereby interferes with the comfortability of the sofa bed.

SUMMARY OF THE INVENTION

It is accordingly an object of the present invention to provide an improved folding bed frame structure for sofa beds or the like, which overcomes the aforementioned disadvantages.

Briefly summarized, the improvements of the present invention are adapted for use in substantially any folding bed frame structure for sofa beds or the like which comprises a plurality of bed sections pivotally connected in end-to-end relation and a linkage arrangement adapted for affixation to a sofa frame or the like and operably associated with the bed sections for supporting them on the frame and controlling their movement in a predetermined pattern between a rearward retracted position in which the bed sections are folded relative to one another within the frame and a forward extended position in which the bed sections are horizontally aligned. In the preferred embodiment, the bed frame structure includes four bed sections a head support section or rear end section, a first or main intermediate section pivotally connected to the head support section, a second intermediate section pivotally connected to the first intermediate section, and a foot support section or forward end section.

Basically, the linkage arrangement includes a support link mechanism for affixation to the frame for pivotably swingably supporting the bed sections thereon and an actuating and control link mechanism associated with the support link mechanism for transmitting folding and unfolding movement to the bed sections.

According to one aspect of the present invention, the support link mechanism includes a support link arranged to extend in a generally upstanding disposition when the bed sections are in the forward extended position and the actuating and control link mechanism includes a bracing link with a stop member rigidly affixed thereto. The bracing link is arranged to extend generally horizontally forwardly in crossing relationship to the support link with the stop member in abutted engagement with a rearwardly facing surface of the support link when the bed sections are in the forward extended position. In this manner, the bracing link prevents accidental downward tilting of the rear end section about the support link by the application of a downward force against the rear end section when the bed sections are in the forward extended position.

According to another aspect of the present invention, the linkage arrangement includes a mattress support bar extending transversely across the intermediate section of the folding bed frame structure and a link mechanism for moving the mattress support bar between a folded disposition in the rearward retracted position of the bed sections wherein the mattress support bar is disposed closely adjacent the intermediate section and a dropped disposition in the forward extended position of the bed sections wherein the mattress support bar is disposed at a sufficient spacing vertically beneath the intermediate section not to interfere with comfortable sleeping use of the bed frame.

In the preferred embodiment, the support link has a fixed pivot at the location of its affixation to the frame and a traveling pivot spaced therefrom whereat the support link is pivoted to a secondary support link which, in turn, is pivoted to the intermediate section. The bracing link is pivoted adjacent a forward end thereof to an actuating link which is operatively associated with the forward end section and the bracing link is further pivoted at a spacing from a rearward end thereof to a control link which is pivoted to the intermediate section. The stop member is affixed to the bracing link at a rearward spacing from its pivot location to the control link. The forward section actuating link is operative to move the bracing link rearwardly to disengage the stop member from the support link upon folding movement of the bed sections from their forward extended position to their rearward retracted position. Preferably, the mattress support bar is affixed to the control link at a spacing from the location of its pivot to the intermediate section. The forward section actuating link is further operative through the bracing link to pivot the control link between its folded and dropped dispositions upon folding and unfolding movement of the bed sections.

DESCRIPTION OF THE PREFERRED EMBODIMENT

Figure 1:
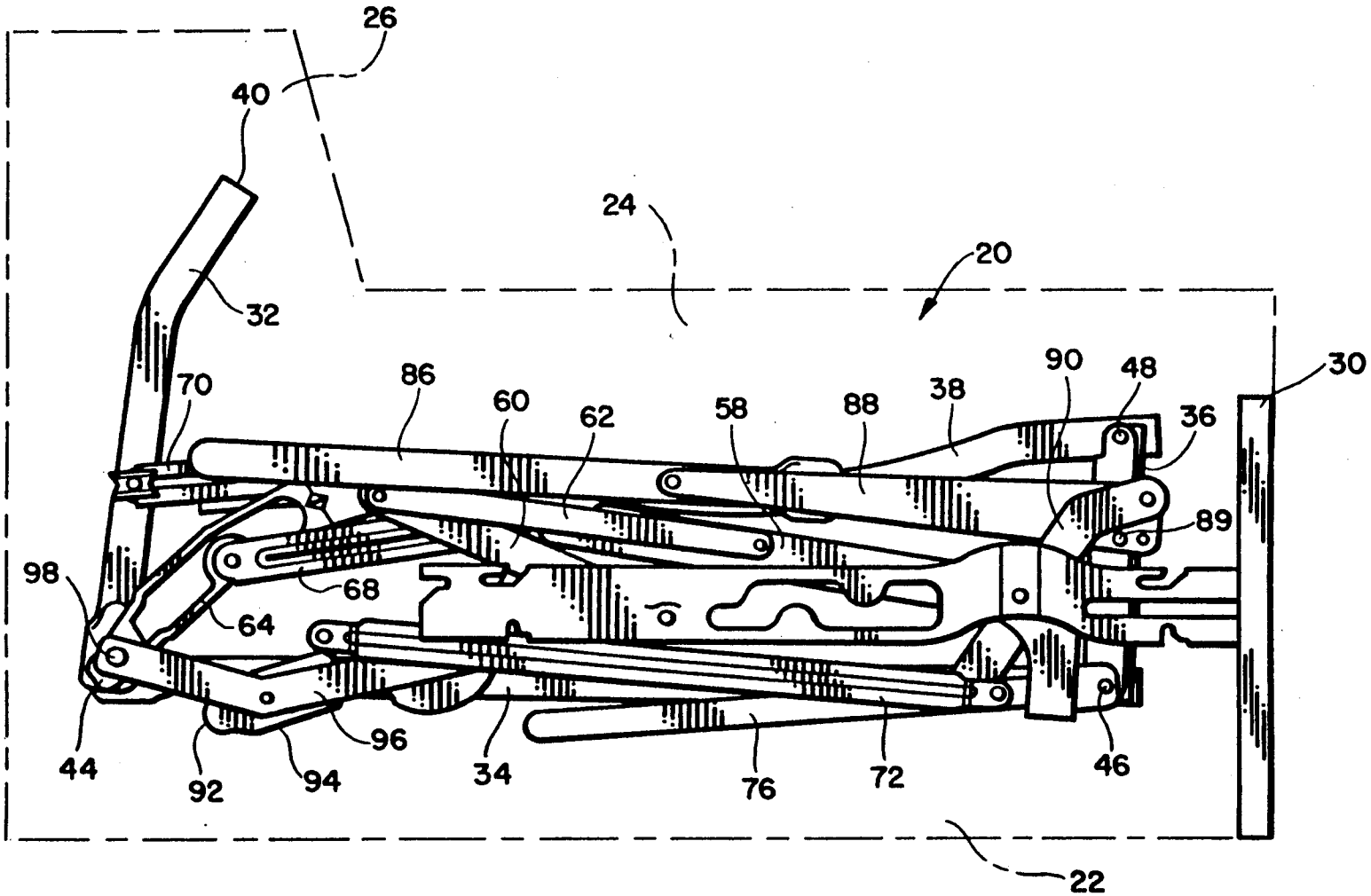
FIGS. 1–6 are side elevational views of an end portion of a sofa bed in which is mounted the preferred embodiment of the folding bed frame structure of the present invention, illustrating the bed frame structure in successive positions in its movement from its retracted position in FIG. 1 to its fully extended position in FIG. 6, the sofa frame being shown schematically in phantom lines for clarity of illustration of the bed frame structure.

Referring now to the accompanying drawings, the folding bed frame structure of the present invention is generally indicated at 20 and is illustrated in its preferred embodiment in a sofa frame 22 of conventional construction. The sofa frame 22 forms no part of the present invention and therefore is illustrated only schematically and in phantom lines in the accompanying drawings to enhance the clarity of illustration of the folding bed frame structure 20. As is conventional, the sofa frame 22 basically comprises a pair of upstanding side frame members 24 spaced in parallel relation to form the sofa armrests, an upright hollow seat back 26 extending horizontally between corresponding sides of the side frame members 24, and a front rail 30 extending horizontally between the other corresponding sides of the side frame members 24 in parallel relation to the seat back 26.

The folding bed frame structure basically includes four bed sections 32,34,36,38 pivotally connected in end-to-end relation and a linkage arrangement adapted for affixation interiorly to the sofa frame 22 and operably associated with the bed sections 32,34,36,38 for supporting them on the sofa frame 22 and articulably actuating and controlling pivotal movement of the bed sections 32,34,36,38 in a predetermined pattern between a rearwardly retracted position in which the bed sections 32,34,36,38 are folded relative to one another within the enclosure of the sofa frame 22 and a forwardly extended position in which the bed sections 32,34,36,38 are horizontally aligned. As used herein, the terms "forward", "rearward" and "intermediate" and variations thereof define positions of the folding bed frame structure 20 relative to the sofa frame 22 and the manner in which the bed frame structure 20 is adapted to be relatively disposed therewithin, "forward" being the direction from the seat back 26 toward the front rail 30 generally parallel with the extent of the side frame members 24 and "rearward" being the opposite direction.

As will be understood, the folding bed frame structure 20 extends between the side frame members 24 substantially the width of the sofa frame 22 and includes identical bed section and linkage components at each side, the corresponding components at the opposite sides of the folding bed frame structure 20 being operably associated for simultaneous identical movement in a conventional manner by the rearward and forward bed sections 32,38, which respectively include integral end portions 40,42 extending transversely between the opposite sides of the bed frame structure 20. In addition, spaced cross members (not shown) may also extend transversely between the bed sections. As the components of the folding bed frame structure 20 are identical at each side, only the components at one side thereof are herein illustrated and described. It will also be understood that a bed spring and fabric covering therefor extend across the bed sections 32,34,36,38 in known fashion to provide a supporting surface for a mattress, the mattress and bed spring arrangement providing in a conventional manner a horizontal surface for support thereon of the seat cushions of the sofa in the aforementioned folded position of the bed frame structure 20 within the sofa frame 22. Neither the bed spring and covering arrangement nor the mattress form any part of the present invention and, accordingly, they are not shown in the drawings in the interest of clarity of illustration.

Looking now in greater detail to the bed frame structure 20 in FIGS. 1–6, the bed sections 32,34,36,38 include a rear end or head support section 32 the end 40 of which is free and unsupported and the other end of which is pivotably connected at 44 to an end of a first intermediate section 34 which forms the main weight-bearing support section of the bed sections. The main intermediate section 34 is pivotably connected at its other end to an end of a second intermediate section 36 at 46, which is pivotably connected at its other end at 48 to an end of a forward end or foot support section 38. As is conventional, each bed section 32,34,36,38 is formed of opposed side rails 50 connected as noted above by cross-members, the free ends of the side rails 50 of the head support section 32 being integral with its transverse end portion 40 and the free ends of the side rails of the foot support section 38 being similarly integral with its transverse end portion 42. Preferably, the side rails 50 of each bed section and the end portions 40,42 of bed sections 32,38 are made of conventional square tubing.

Figure 2:
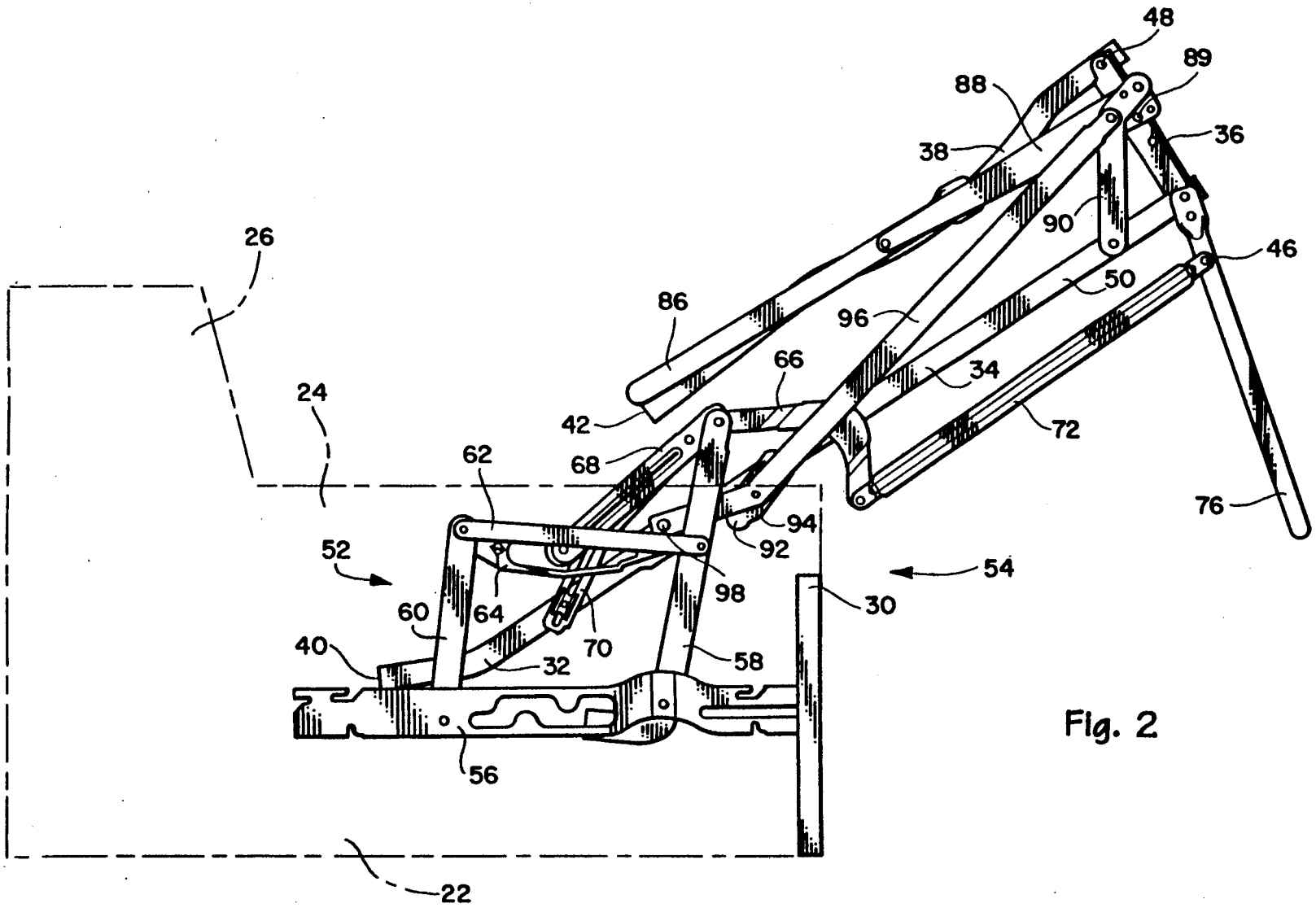
Figure 3:
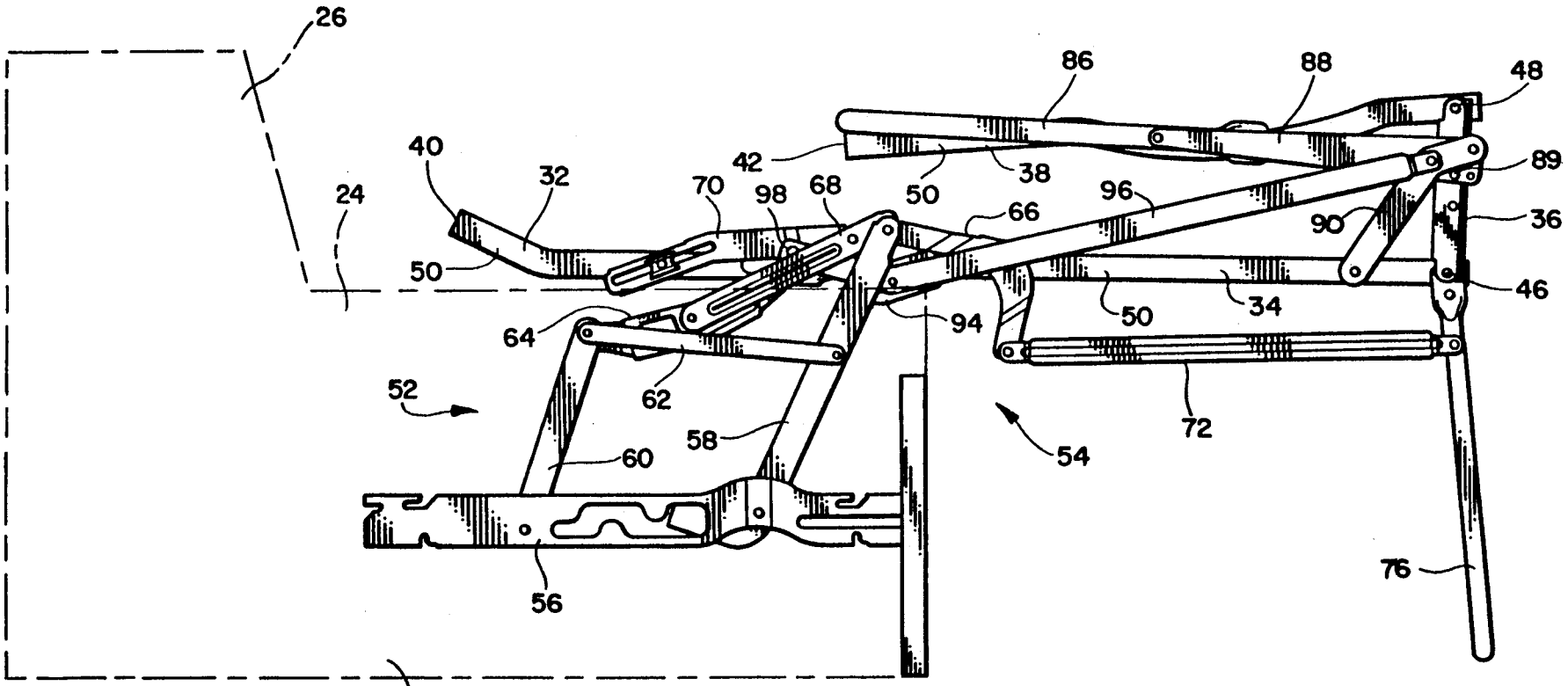
Figure 4:
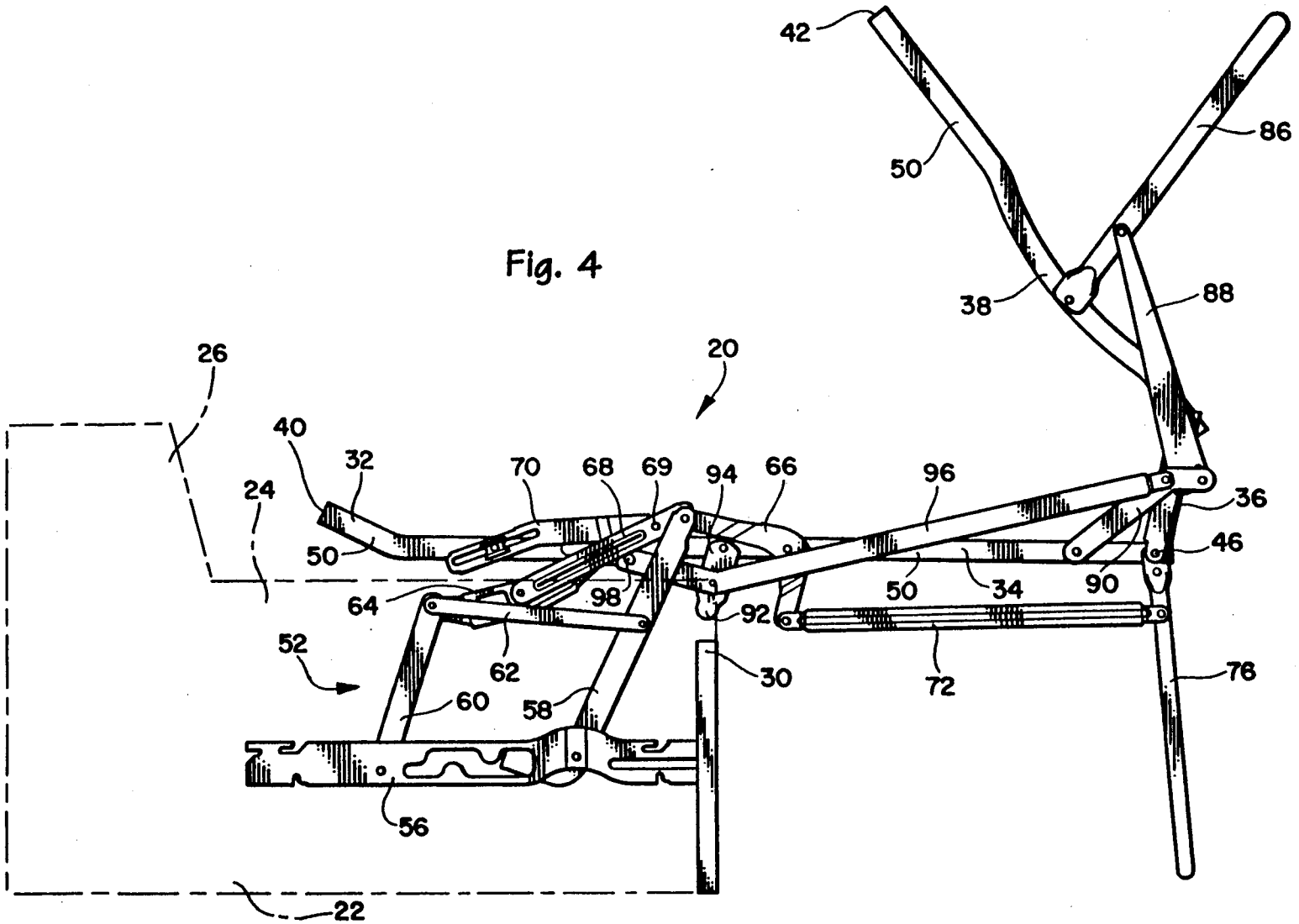
Figure 5:
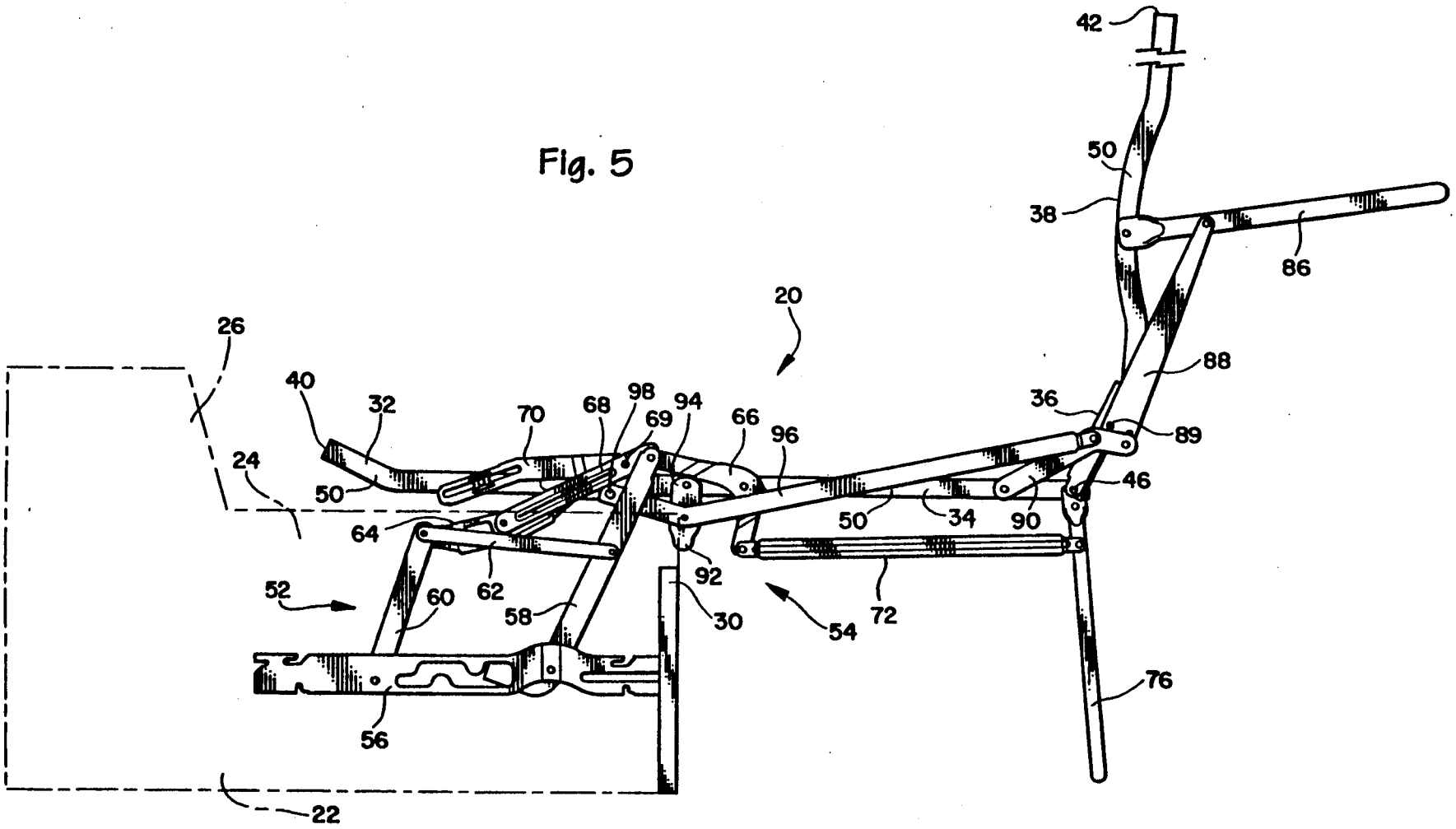

The linkage arrangement of the bed frame structure 20 basically comprises a support linkage arrangement, indicated generally at 52 in FIGS. 2 and 3, for supporting the bed sections 32,34,36,38 on the sofa frame through their movement between their folded and extended positions and an actuating and control linkage arrangement, indicated generally at 54 in FIGS. 2 and 3, associated with the support linkage 52 for transmitting folding and unfolding movement to the bed sections 32,34,36,38. As will be hereinafter explained in greater detail, the support linkage 52 and the actuating and control linkage 54 are cooperatively arranged to cause the bed sections 32,34,36,38 to fold relative to one another within the sofa frame 22 with the rear end section 32 in an upstanding disposition extending upwardly within the hollow sofa back 26 and with the main intermediate and forward end sections 34,36 disposed forwardly of the rear end section 32 in superposed, substantially parallel relation spaced apart by the second intermediate section 36 which assumes a vertical disposition forwardly of the main intermediate and forward sections 34,38, and to cause the bed sections 32,34,36,38 to articulably unfold from such folded disposition forwardly and upwardly from the sofa frame enclosure over the front rail 30 to the horizontally aligned extended position.

The support linkage 52 includes a horizontal support bracket 56 adapted for affixation interiorly to the side frame members 24 of the sofa frame 22, two primary support links 58,60, being pivotably fixed at a horizontal spacing to the support bracket 56. As can be seen from the drawings, the forward support link 58 is substantially longer than the rear support link 60. A control link 62 extends between the two support links 58,60, the control link 62 being pivotably affixed at one end thereof to the outward free end of the rear support link 60 and being pivotably affixed at the other end thereof intermediately to the front support link 58. One end of a secondary support link 64 is also pivotably affixed with the rear support link 60 and the control link 62 at the outward free end of the rear support link 60 and extends therefrom and is pivotably connected to the main intermediate bed section 34 at its pivot 44 with the rear end bed section 32, thereby to provide support for such bed sections 32,34. Another secondary support link 66 in the form of a bell crank is pivoted at an intermediate point thereon to the side rail 50 forming the main intermediate section 34 intermediate pivots 44,46 at the ends of the main intermediate section 34, with one end of the secondary support link 66 being pivotably affixed to the outward free end of the front support link 58, thereby providing additional support for the main intermediate bed section 34.

The actuating and control linkage 54 extends in association with the four bed sections 32,34,36,38 substantially the length thereof. A rear end section control link 68 is pivotably affixed at one end thereof to the secondary support link 64 intermediate its ends and extends to the outward free end of the front support link 58 at which the control link 68 is pivoted commonly with the front support link 58 and the secondary support link 66. A rear end section actuating link 70 is pivoted at one end thereof to the control link 68 at 69 at a slight spacing from the pivot point between the control link 68 and the front support link 58, and the actuating link 70 extends therefrom to a point intermediate the ends of the rear end section 32 at which the actuating link 70 is pivotably connected to the side rail 50 of the rear end section 32, the control link 68 and the actuating link 70 being thus arranged to respectively transmit folding and unfolding movement to the rear end section 32 as hereinafter more fully explained.

As will be understood, the main intermediate section 34 is horizontally disposed in both the folded and extended positions and moves between the positions in a substantially translatory manner. A support leg 76 is pivoted to the main intermediate section at its forward end at the pivot 46 to provide additional support for the main intermediate section 34 in the extended position. An actuating link 72 extends between and is pivotably connected at its opposite ends to the other arm of the bell-crank secondary support link 66 and to the support leg 76 at a slight spacing from the pivot 46, the actuating link 72 being thereby arranged to actuate pivoting of the support leg 76 between a folded disposition alongside the main intermediate section 34 and a vertical disposition depending from the main intermediate section 34 upon the movement of the bed sections 32,34,36,38 between their folded and extended positions, respectively.

A forward support leg 86 is pivotably connected to the forward end section 38 intermediately along its length to provide support therefor in the extended position. An actuating lever 88 is fulcrumed at 89 adjacent one end thereof to the second intermediate section 36 intermediately along its length, e.g. approximately midway therealong, with the opposite distal end of the lever 88 being pivotably connected to the support leg 86 One end of an angular actuating link 90 is pivotably connected to the end of the lever 88 adjacent its fulcrum 89 and the opposite end of the actuating link 90 is pivotably connected to the main intermediate section at a spacing from its pivot 46. In this manner, the actuating lever 88 and the actuating link 90 cooperatively actuate movement of the forward leg 86 between a folded disposition alongside the forward end section 38 in the folded position of the bed structure 20 and a vertical supporting disposition depending from the forward end section 38 in the extended position of the bed structure 20.

A control link 94 is pivoted in depending relation to the side rail of the main intermediate section 34 at a short spacing from the location of its pivot 44 with the rear end section 32, with the depending end of the control link 94 being integral with an elongate mattress support bar 92 which extends transversely across the full width of the folding bed frame structure 20 directly beneath the main intermediate section 34. An elongate bracing link 96 extends substantially the full length of the main intermediate section 34, the bracing link 96 being pivotably connected at a spacing from its rearward end to the control link 94 and being pivotably connected at its forward end intermediately to the angular actuating link 90. In this manner, the bracing link 96 is operated by the actuating lever 88 and the actuating link 90 during folding and unfolding movements of the bed frame structure 20 to pivot the control link 94 between a folded disposition alongside the main intermediate section 34 to dispose the mattress support bar 92 closely adjacent the underside of the intermediate section 34 when the bed structure 20 is in its retracted position and a dropped disposition extending substantially vertically downwardly from the main intermediate section 34 to dispose the mattress support bar 92 at a vertical spacing beneath the intermediate section 34 when the bed structure 20 is in its extended position.

Figure 6:
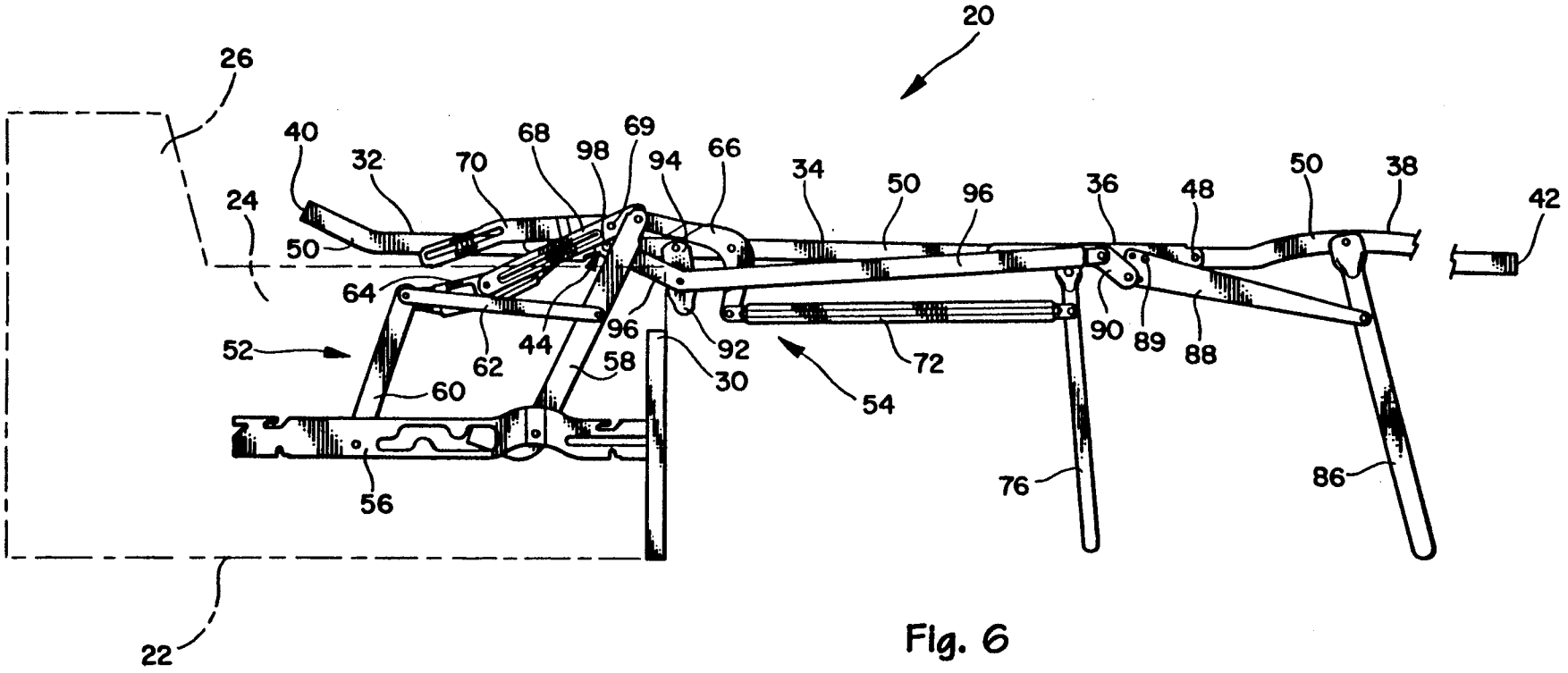

The bracing link 96 has a sufficient length extending rearwardly from its pivot connection to the control link 94 to dispose the rearward end of the bracing link 96 rearwardly of the extent of the forward support link 58 between the control link 62 and the control link 68 when the bed frame structure 20 is in its fully extended position, as best seen in FIG. 6. A cylindrical stud 98 is affixed to and extends outwardly from the bracing link 96 at a location adjacent its rearward end selected such that the stud 98 positively abuts the rearwardly facing side of the forward support link 58 between the control links 62 and 68 in the fully extended position of the bed structure 20.

The folding and unfolding operation of the bed frame structure 20 is as follows. Initially, the seat cushions of the sofa are removed. With the bed frame structure 20 in the folded condition of FIG. 1, the underside of the bed spring and fabric cover arrangement extending between the side rails of the forward end section 38 faces upwardly. According to conventional practice, a handle member (not shown) is provided adjacent the front rail, either formed in the bed spring and cover arrangement or formed on a cross member between the side rails of the forward end section 38, whereby the structure 20 may be manually lifted from its stored position. The exertion of a lifting force to the structure through the handle member operates to swingably pivot the support links 58,60 in generally parallel relation under the constraint of the control link 62 into an essentially upstanding disposition of the support links 58,60, as shown in FIGS. 2 and 3. During such motion, the secondary support link 64, the control link 68 and the actuating link 70 cooperate to pivot the rear end section 32 downwardly into substantial alignment with the main intermediate section 34. At the same time, the bell-crank secondary support link 66 is operated by the forward support link 58 to transmit unfolding movement of the support leg 76 through the actuating link 72.

As can be seen from FIGS. 1-3, the relative positions of the main intermediate, second intermediate and forward end sections 34,36,38 remain unchanged through the above-described movement. In the position of FIG. 3, the bed frame structure 20 is supported in a stable disposition with its rear end and main intermediate sections 32,34 supported in horizontal disposition in alignment with one another by the support links 58,60,64,66 and by the support leg 76. The second intermediate and forward end sections 36,38 are moved into horizontal alignment with the rear end and main intermediate sections 32,34 by manually pulling forward on the forward support leg 86 and then pulling forward on the end portion 42 to cause the second intermediate section 36 to pivot about its pivot 46 with the main intermediate section 34 and to cause the forward end section 38 to pivot about its pivot 48 with the second intermediate section 36, as shown sequentially in FIGS. 4-6. As the second intermediate and forward end sections 36,38 are unfolded in this manner, the actuating lever 88 and the actuating link 90 cause the forward support leg 86 to pivot outwardly from alongside the forward end section 38 into a vertical supporting disposition depending therefrom. At the same time, the actuating link 90 translates the bracing link 96 forwardly, thereby pivoting the control link 94 and the mattress support bar 92 downwardly and at the same time moving the stud 98 forwardly into abutting engagement with the forward support link 58, as shown in FIG. 6.

In this disposition, the stud 98 acts as a stop member in the extended disposition of the bed frame structure 20 to prevent accidental and undesired upward tilting movement of the forward end thereof when a significant force or weight is applied to the rearward end section 32. More specifically, without the stud 98 in engagement with the support link 58, the application of any significant force or weight to the rearward end section 32, unless counterbalanced by a corresponding force or weight on one or more of the other bed sections 34,36,38, will tend to pivot the rearward end section 32 downwardly and the intermediate and forward end sections 34,36,38 upwardly generally about a pivot location at the upper end of the forward support link 58. However, with the stud 98 in engagement with the rearward side of the forward support link 58, the bracing link 96 is effective to brace or lock the actuating and control linkage 54 against such undesired pivotal movement.

Additionally, with the control link 94 pivoted downwardly by the action of the bracing link 96 in the extended position of the bed frame structure 20 of FIG. 6, the transverse mattress support bar 92 is disposed at a sufficient spacing vertically beneath the bed spring and fabric cover arrangement at the main intermediate bed section 34 so as not to interfere with normal use of the bed frame structure 20. Specifically, while the weight of users on the sofa bed frame structure 20 may be sufficient to cause some contact of the bed spring and fabric cover arrangement with the mattress support bar 92, the spacing of the mattress support bar 92 substantially prevents such contact from being noticed by the users, thereby promoting comfortable sleeping usage of the bed frame structure 20 as compared to the conventional folding bed frame structures described above.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A folding bed frame structure for sofa beds, comprising a plurality of bed sections including a rear end section, an intermediate section, and a forward end section, pivotally connected in end-to-end relation, linkage means adapted for affixation to a sofa frame and operably associated with said bed sections for supporting said bed sections on said frame and controlling movement of said bed sections in a predetermined pattern between a rearward retracted position in which said bed sections are folded relative to one another within said frame and a forward extended position in which said bed sections are horizontally aligned, said linkage means including support link means for affixation to said frame for pivotably swingably supporting said bed sections thereon and actuating and control link means associated with said support link means for transmitting folding and unfolding movement to said bed section, said support link means including a support link arranged to extend in a generally upstanding disposition when said bed section are in said forward extended position, and said actuating and control link means including a bracing link with a stop member rigidly affixed thereto, a control link affixed to said intermediate section, a mattress support bar affixed to said control link and extending transversely across said intermediate section, and an actuating link affixed to said bracing link and to said control link for actuating movement of said bracing link to extend generally horizontally forwardly in crossing relation to said support link with said stop member in abutted engagement with a rearwardly facing surface of said support link when said bed sections are in said forward extended position for preventing accidental downward tilting of said rear end section about said support link by the application of a downward force against said rear end section when said bed sections are in said forward extended position, and for actuating movement of said control link to extend downwardly from said intermediate section when said bed sections are in said forward extended position to disposed said mattress support bar at a sufficient spacing vertically beneath said intermediate section not to interfere with comfortable sleeping use of said bed frame.

2. A folding bed frame structure according to claim 1 and characterized further in that said actuating and control means includes means for manipulating said bracing link to disengage said stop member from said support link upon folding movement of said bed sections from said forward extended position to said rearward retracted position to permit folding movement of said support link.

3. A folding bed frame structure according to claim 2 and characterized further in that said support link has a fixed pivot at the location of its affixation to said frame and a traveling pivot spaced therefrom, said traveling pivot moving between a location rearwardly of said fixed pivot in said rearward retracted position and another location forwardly of said rearward location in said extended position.

4. A folding bed frame structure according to claim 3 and characterized further in that said support link is pivoted at its said traveling pivot to a secondary support link which is pivoted to said intermediate section.

5. A folding bed frame structure according to claim 3 and characterized further in that said bracing link is pivoted adjacent a forward end thereof to said actuating link, said actuating link being operatively associated with said forward end section and being pivoted at a spacing from a rearward end thereof to said control link, said control link being pivoted to said intermediate section, said stop member being affixed to said bracing link at a rearward spacing from its pivot location to said control link.

6. A folding bed frame structure according to claim 5 and characterized further in that said actuating link is operative to move said bracing link rearwardly to disengage said stop member from said support link upon folding movement of said bed sections from said forward extended position to said rearward retracted position.

7. A folding bed frame structure according to claim 5 and characterized further by a mattress support bar affixed to said control link at a spacing from the location of its pivot to said intermediate section, said actuating link being operative to pivot said control link between a folded disposition in the rearward retracted position of said bed sections wherein said mattress support bar is disposed closely adjacent said intermediate section and a dropped disposition in said forward extended position of said bed sections wherein said mattress support bar is disposed at said sufficient spacing vertically beneath said intermediate section not to interfere with comfortable sleeping use of said bed frame.

* * * * *

UNITED STATES PATENT AND TRADEMARK OFFICE

CERTIFICATE OF CORRECTION

PATENT NO. : 5,138,727

DATED : August 18, 1992

INVENTOR(S) : Fred E. Hanes and Joseph E. Becker

It is certified that error appears in the above-identified patent and that said Letters Patent is hereby corrected as shown below:

Abstract, line 5 (not including heading), delete "horiziontally" and insert therefor -- horizontally --.

Column 2, line 3, after "sections" insert -- : --.

Column 5, line 64, after "86" insert -- . --.

Column 8, line 40, delete "section" and insert therefor -- sections --.

Column 8, line 42, delete "section" and insert therefor -- sections --.

Column 8, line 62, delete "disposed" and insert therefor -- dispose --.

Signed and Sealed this

Thirty-first Day of August, 1993

*Attest:*

*Attesting Officer*

BRUCE LEHMAN

*Commissioner of Patents and Trademarks*